United States Patent [19]

Hannen

[11] Patent Number: 4,481,754

[45] Date of Patent: Nov. 13, 1984

[54] EQUIPMENT FOR COVERING STACKED GOODS WITH SHRINKABLE HOODS

[75] Inventor: Rainer Hannen, Goch, Fed. Rep. of Germany

[73] Assignee: MSK-Verpackungs-Systeme Gesellschaft m.b.H., Kalkar-Wissel, Fed. Rep. of Germany

[21] Appl. No.: 279,844

[22] Filed: Jul. 2, 1981

[30] Foreign Application Priority Data

Jul. 5, 1980 [DE] Fed. Rep. of Germany ..... 3025576
May 9, 1981 [DE] Fed. Rep. of Germany ..... 8113736

[51] Int. Cl.[3] ..... B65B 9/10
[52] U.S. Cl. ..... 53/567; 53/241
[58] Field of Search ..... 53/450–451, 53/456, 552, 567, 241

[56] References Cited

U.S. PATENT DOCUMENTS 3,792,565 2/1974 Goransson ..... 53/567
3,895,480 7/1975 Lombardo ..... 53/241 X
3,925,964 12/1975 Birkenfeld ..... 53/567

*Primary Examiner*—A. J. Heinz
*Attorney, Agent, or Firm*—Shlesinger Arkwright Garvey & Fado

[57] ABSTRACT

Apparatus for pulling hoods made of shrinkable foil over stacks of wares comprising a supply spool, a continuous, flattened foil sleeve having a free openable end wound upon the supply spool, mobile gripping means for seizing the free end of the sleeve and for drawing the sleeve from the supply spool, support means for contacting and guiding the external surface of the drawn sleeve, spreading means supported by the support means and receivable within the free end of the sleeve for engaging and spreading apart the opposed walls of the drawn sleeve, a welding and cutting device for subsequently welding a cross-seam in the spread apart sleeve at a location on the sleeve remote from the free end and for subsequently severing the sleeve at a location adjacent to the cross-seam, thereby forming a newly formed separated hood having a spread apart open end and a sealed end while also providing the undetached portion of the sleeve with a newly formed, spread apart free end, the open end of the hood being seized by the mobile gripping means for subsequent placement over a stack of goods, the mobile gripping means being subsequently engagable with the newly formed, opened free end of the sleeve for drawing additional sleeve from the supply spool.

18 Claims, 15 Drawing Figures

Figure 1:
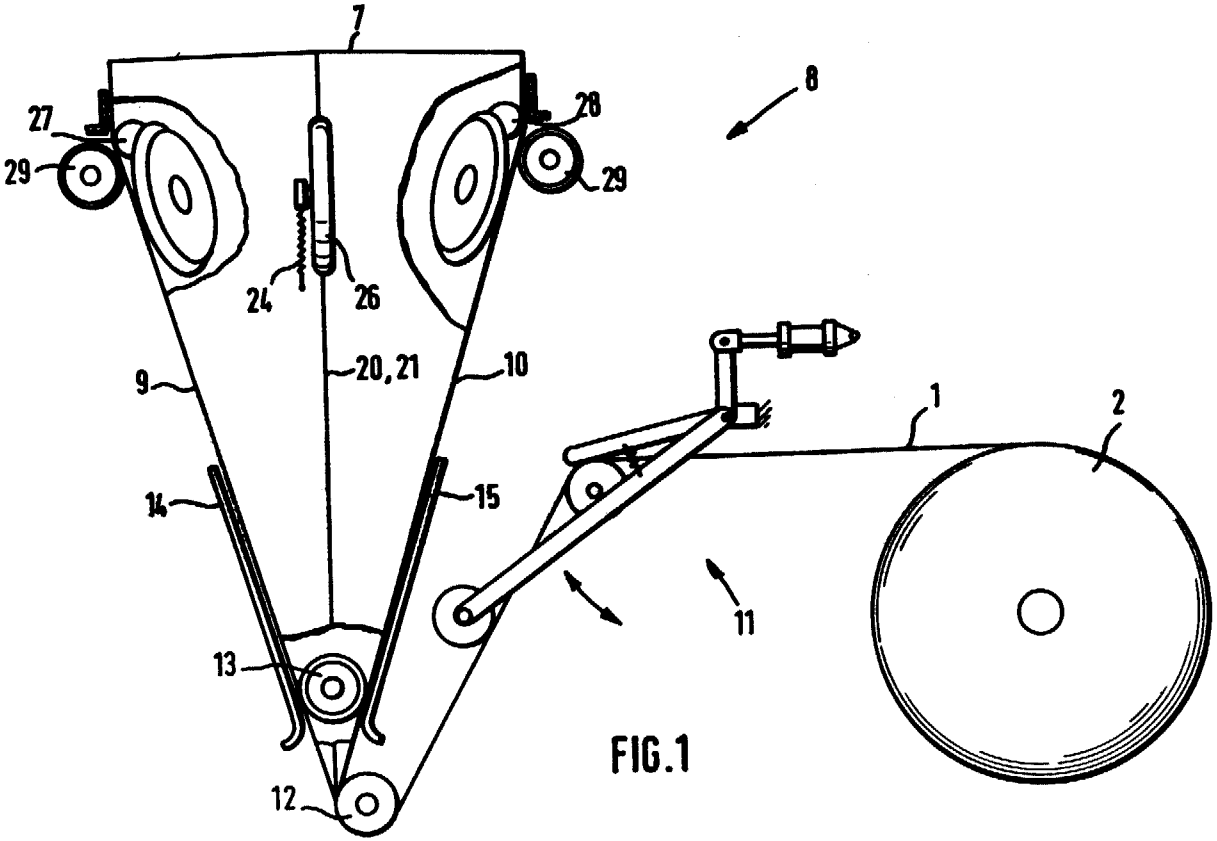

FIG. 10
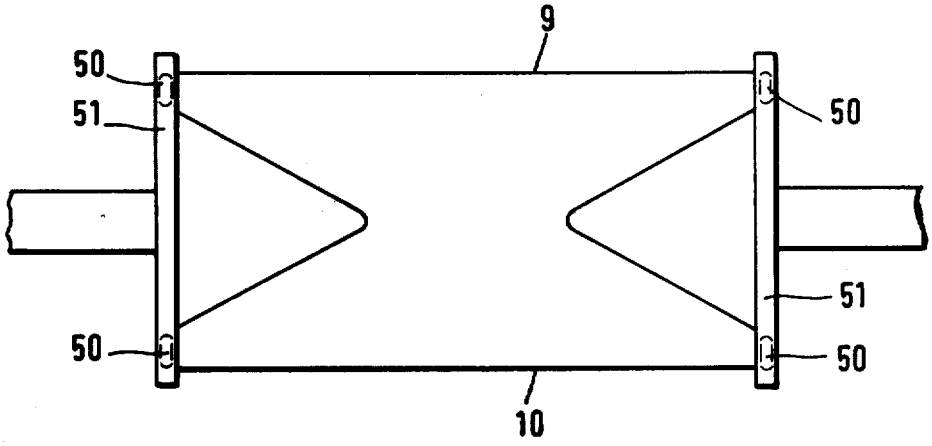
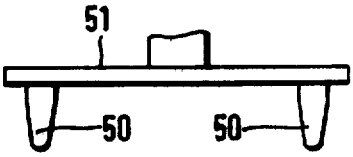
FIG. 11

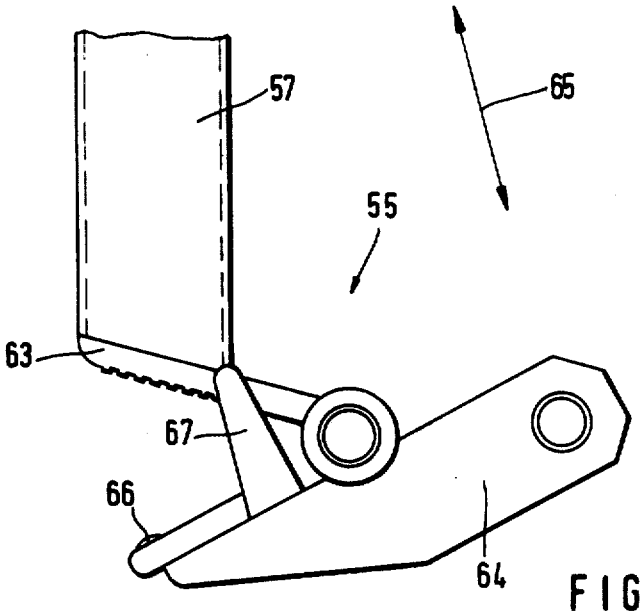
FIG. 14
FIG. 15
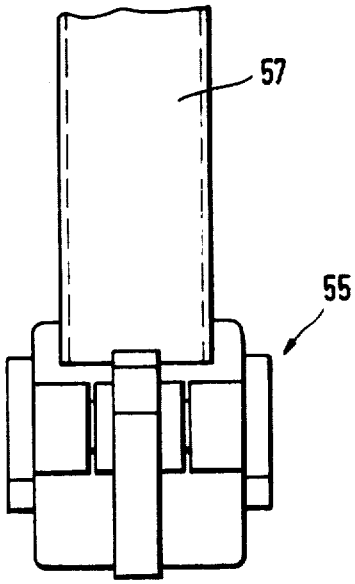

EQUIPMENT FOR COVERING STACKED GOODS WITH SHRINKABLE HOODS

The invention concerns equipment for pulling hoods made of shrinkable sleeves of foil over stacks of goods, comprising a device for unwinding the flat-laid sleeve of foil from a supply roll, a fusing and cutting device to seam crosswise and cut the sleeve, and movable gripping means to hold the free hood edge.

Shrinkable hoods are pulled by means of such equipment on finished, especially pallet-held stacks of goods brought to the equipment on a conveyor means or being made to pass by it, where these hoods are shrunk in a subsequent heat treatment and thereupon enclose the stack of goods as a relatively firm packing. The shrink hoods are formed in the equipment by sections of corresponding length of a foil sleeve being taken off a supply roll are severed and provided with a bottom cross-seam. These shrink hoods are gripped at the open end by movable gripping means, unfolded and pulled over the stack of goods by pivoting the gripping means. Preferably hoods with side pleats are used for these purposes, which are formed by the flat-laid foil sleeve and with side pleats laid in between the two opposite walls of said sleeve.

As the walls and/or side pleats of the flat-laid and wound foil sleeve are pressing hard against each other and correspondingly also adhere to one another, difficulties are met with when operating equipment of the initially described kind in that the walls or the side pleats forming the free hood edge must first be detached from each other before the gripping means can take hold of them. As a rule this require manual labor, i.e. the particular edges must be separated from each other and be moved by hand into the gripping means. This is laborious. The invention remedies this condition.

It is the object of the invention to so improve equipment of the initially described species that it will be extensively suited for automatic operation.

This problem is solved by mounting the movable gripping means above the fusing and cutting device while mounting the means for spreading open the mutually opposite walls of the flat-laid foil sleeve beneath the fusing and cutting device out within the end of the sleeve.

When the foil sleeve taken off the roll and possibly moving on a direction-changing roller located below the spreading means passes this spreading means, its walls necessarily are opened, the degree of spreading being adaptable to the particular desired conditions. The spreading means located within the sleeve end essentially acts by its own weight and spreads the sleeve segment pulled over it as a function of its geometry. The sleeve end so spread open can be taken hold of by gripping means and be pulled through the fusing and cutting device as far as a height corresponding to the desired hood length. Thereupon the fusing and cutting device located above the spreading means is actuated, which on one hand lays a cross-seam and on the other hand severs the wound off sleeve section which presently hangs from the gripping means as a finished hood which will subsequently be pulled by the gripping means over the stack of goods located next to the equipment. The newly formed sleeve end remaining underneath the fusing and cutting device is spread open and can be seized by the gripping means during the next operational cycle without manual labor.

The spreading means may comprise a spreading structure with an essentially triangular cross-section in its projection perpendicular to the sleeve axis and comprising glide means or rollers to guide the sleeve walls at its ends. In particular this spreading structure shall comprise in the area of its lower triangular tip at least one roller and on the side facing the fusing and cutting device at least four rollers. In this manner it is easily possible to spread a foil sleeve of a given circumference and without forming pleats or waves in the foil walls to achieve an essentially rectangular cross-section at the upper end of the spreading means.

Appropriately support plates or support rolls are provided for the slide means or rolls and are borne in rigid manner in the machine structure, which form glide means for the foil sleeve when passing through the spreading means and possibly supporting the spreading means when the foil sleeve is pulled from top to bottom. Moreover this arrangement provides rigid mounting to the machine of the spreading means and the subsequent fusing and cutting device and of the movable gripping means.

If hoods shall be pulled over stacks of goods by means of the side-pleats hood equipment, then an embodiment is recommended wherein the four rollers of the spreading structure act between the walls and the side pleats in the area of the outer pleat lines and wherein two further rollers are arranged at the machine frame especially at the height of those four rollers, where the two further rolls act from outside on the inner fold lines of the side pleats. The externally acting rollers may be spring-loaded, so that circumference of the foil sleeve can be compensated and the walls or the side pleats be always guided at low tension and smoothly through the equipment.

As the foil sleeve should not be totally but only partly spread open in view of the subsequent fusing and cutting device, more or less acute angles are formed between the walls on one hand and the adjoining side pleats on the other. To improve the guidance of the foil sleeve in the region of these angles, the four upper rollers of the spreading structure may be designed as flat disks of which the disk plane extends approximately centrally between planes formed the associated wall on one hand and the plane formed by the adjoining side pleat on the other. The disks then rest against the foil sleeve at its circumference only in the area of the associated pleat lines, and moreover they rest on the support plates or rollers mounted outside the foil sleeve.

Because the ready hoods are seized as a rule by the gripping means at their wide walls before being completely spread open and being pulled over the stacks of goods; it is advantageous to mount guide-rolls at the spreading structure between every two rollers for the purpose of guiding the walls of the foil sleeve, in particular of the side pleat sleeve, with which are moreover associated support rollers outside the foil sleeve. In that case the walls of the foil sleeve are additionally guided by these guide-rolls and they also may be drawn smooth after the gripping means have seized the free end of the foil sleeve and are pulling off a further section of the foil sleeve.

This initially cited problem is solved by mounting the movable gripping means essentially underneath the fusing and cutting device and in that above the fusing and cutting device but within the sleeve end there be a means for separating open the mutually opposite walls of the flat-laid foil sleeve, where this spreading means rests on the machine frame.

When the foil sleeve taken off the supply roll and possibly moving on a direction-changing roller mounted above the spreading means passes this spreading means, its walls perforce are spread open and the degree of opening may be adapted to the desired particular conditions. The spreading means located within the sleeve end rests through the walls of the sleeve end on the machine frame and spreads the sleeve section pulled over it as a function of its geometry. The spread-open sleeve-end then can be seized underneath the spreading means by the gripping means and be immediately pulled over the stack of goods after the fusing and cutting device was activated and after a sleeve section corresponding to the desired hood length was cut off and provided with a cross-seam.

The spreading means may comprise a spreading structure with an essentially triangular cross-section in a projection perpendicular to the sleeve axis and provided with guide means or rollers to guide the sleeve walls in the area of the ends of said structure. In particular the spreading structure shall comprise at least four rollers at its underside to which are associated support rolls external to the foil sleeve. Each of these rollers and its associated support roll shall be axially parallel. In one embodiment for the drawing of side-pleat hoods over the stack of materials it is recommended to let four rollers of the spreading structure act between the walls and the side pleats in the area of the outer pleat lines, two further rolls being mounted at the machine frame especially at the height of these four rollers to act externally on the inside folds of the side pleats. The externally acting rolls may be spring-loaded, whereby also circumferential tolerances of the foil sleeve can be compensated and the walls or side pleats can always be guided with little tension and a smooth surface through the equipment.

As in view of the subsequent fusing and cutting device the foil sleeve should not be spread open completely but first only partly, more or less acute angles are formed between the walls on one hand and the adjoining side pleats of the foil sleeve on the other. To improve the guidance of the foil sleeve in the area of these angles, the four rollers of the spreading structure can be designed as flat disks of which the disk plane extends about centrally between the planes formed at the spread-open sleeve end on one hand by the associated wall and on the other by the adjoining side pleat. Additionally a guide plate for the foil can be mounted next to each of these four rollers in order that the free end of the foil sleeve shall be reliably seized by the gripping means or a tensioning device. In order that the spreading structure mounted within the foil sleeve be reliably supported by the machine frame, rolls acting on the plane walls of the spread foil sleeve should be mounted in the region of the underside of the spreading structure, which rest on the support rolls rigidly born by the machine and arranged outside the foil sleeve. In addition further rolls may be mounted approximately at half height of the spreading structure to act on the plane walls of the foil sleeve and resting on machine-fixed support rolls mounted outside the foil sleeve.

In order that the gripping means reliably seize the lower edge of the spread open foil sleeve, it is appropriate to provide underneath the spreading structure a device for holding open the opening of the sleeve end and comprising tensioning fingers tensioning the opening. The tensioning fingers appropriately are guided by lever mechanisms with an associated hydraulic or pneumatic cylinder as the setting means. After the tensioning fingers have entered the opening, they are pulled apart in such a manner that they tension especially the broad sides of the foil sleeve, which thereby assume a predetermined spatial position and orientation, whereby next the gripping means can be brought near and thusly seize the edges of these broad sides.

In a preferred embodiment of the invention, the gripping means consist of gripping tongs mounted on the controlled, movable gripper arms. One of the tong jaws is solidly fixed to the gripper arm while the other tong jaw is hingingly supported by the gripper arm on which it rests through the intermediary of a setting means. As the gripper arms need being moved only at a specific location, where then the lower edge of the foil sleeve will be located, the gripper arms mechanism can be of a relatively simple design. It is merely recommended to take care that when the gripper tongs are closed, only the free ends of the tong jaws should touch each other, so that in this manner a specific clamping pressure be exerted on the seized edge of the foil sleeve. This can be implemented for instance in that the point of rotation of the two tong jaws be outside the planes formed by the insides of the tong jaws. In other embodiments the tong jaws may be made of a flexible material, and also the ends of the tong jaws may be made convex.

In order that the hood pulled over the stack of goods by means of the grippers easily detach from the gripper tongs, a further suggestion of the invention consists in mounting a stripping means on the movable tong jaw. This may be a simple lever which upon rotation of the movable tong jaw strips the edge of the hood from the other tong jaw.

Figure 2:
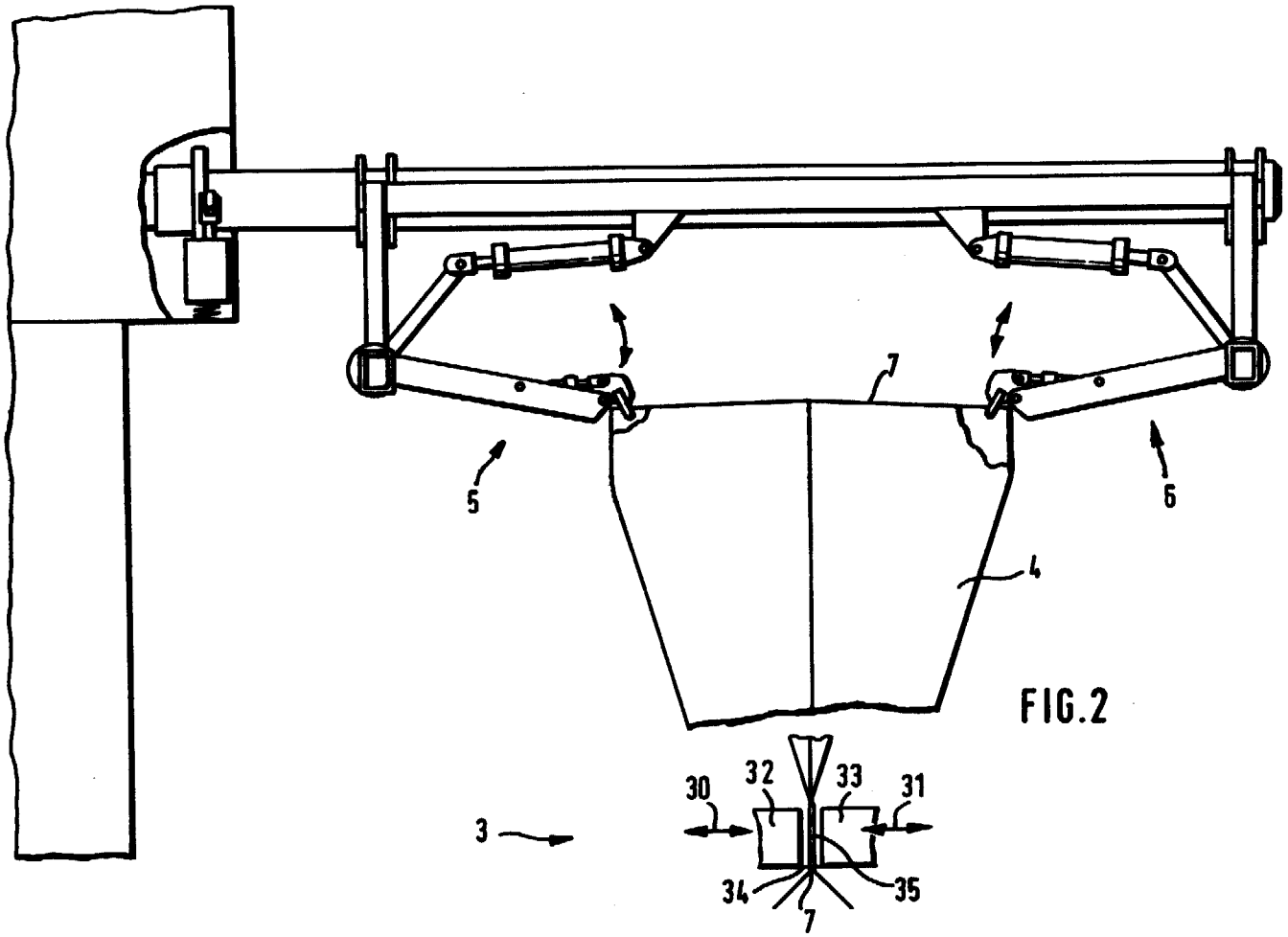
Figure 3:
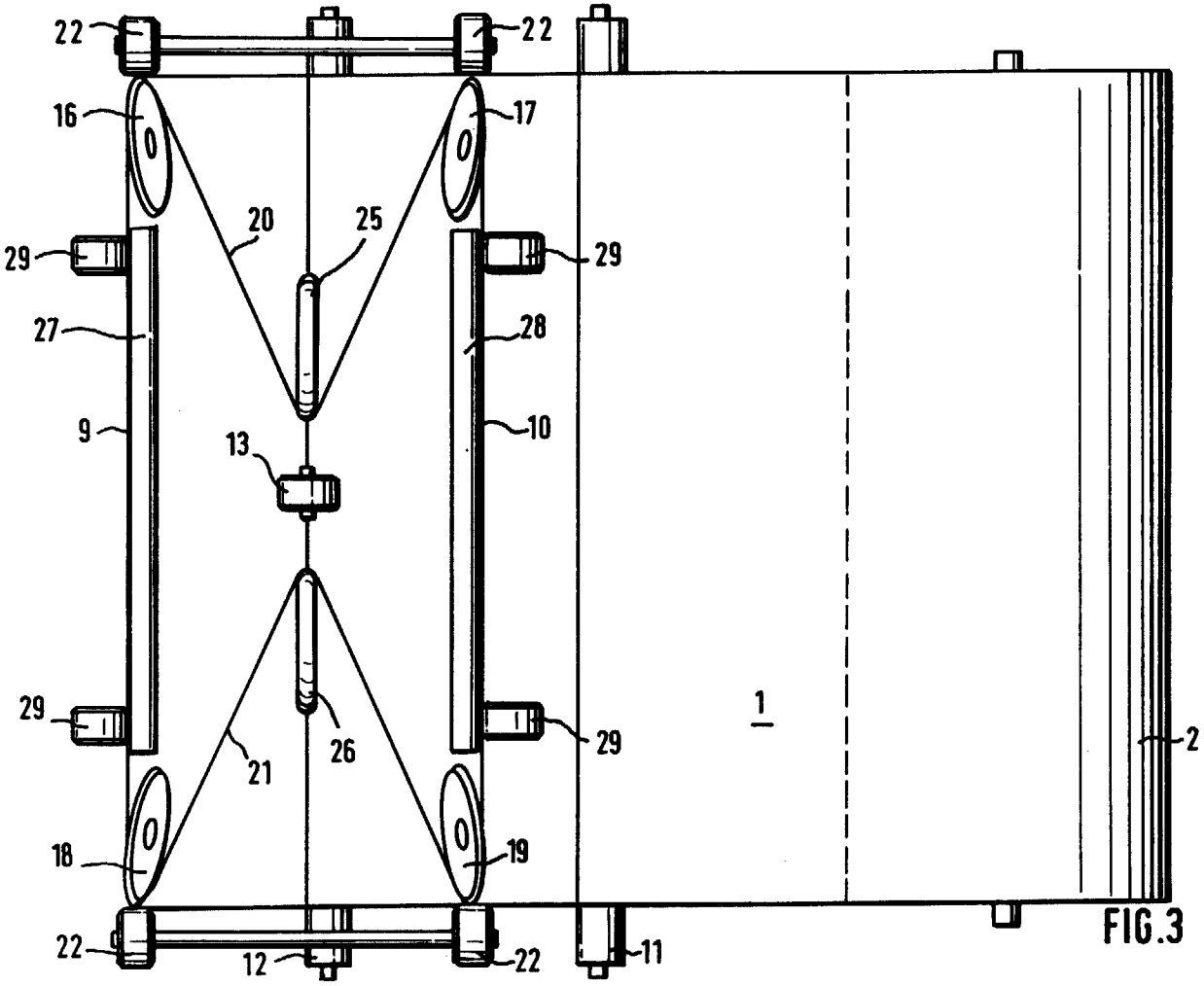
Figure 4:
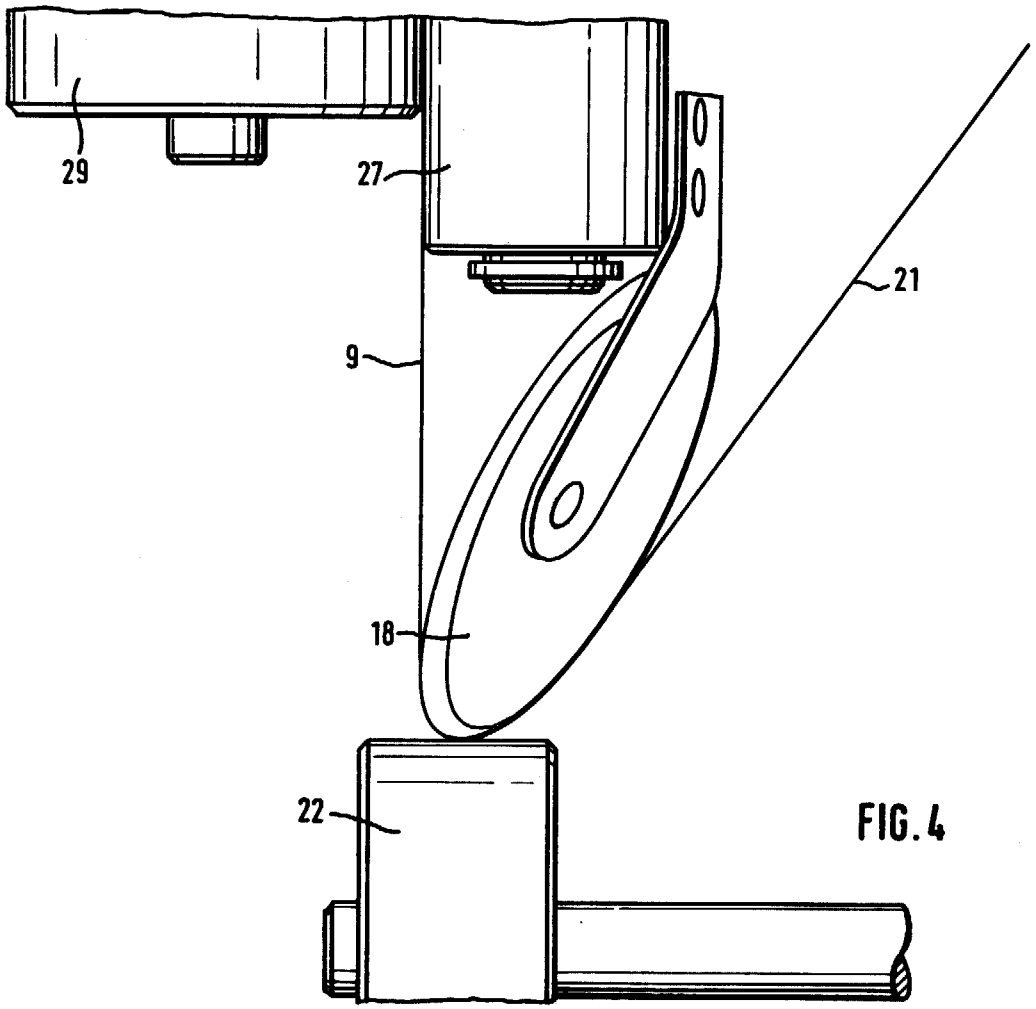
Figure 5:
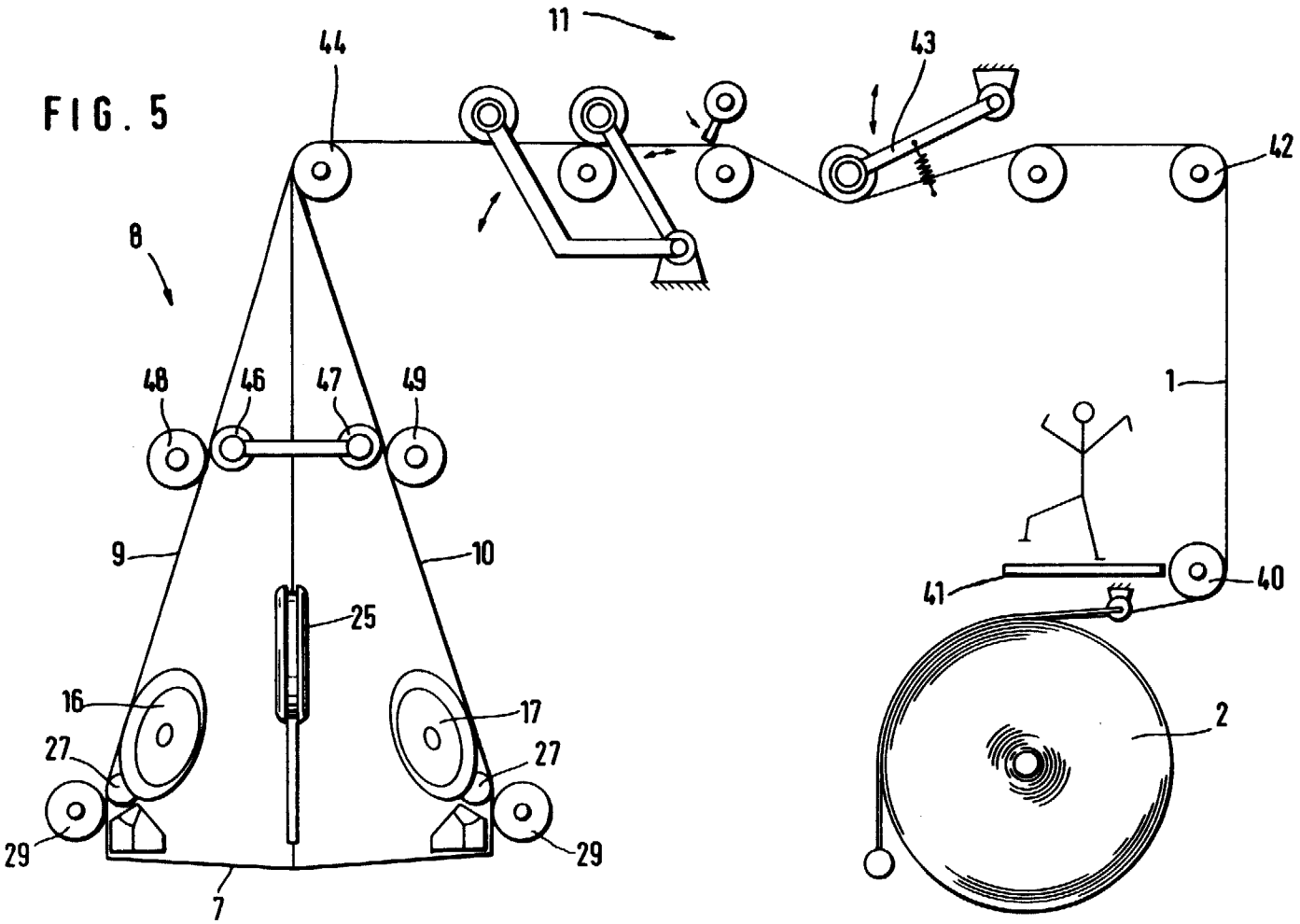
Figure 6:
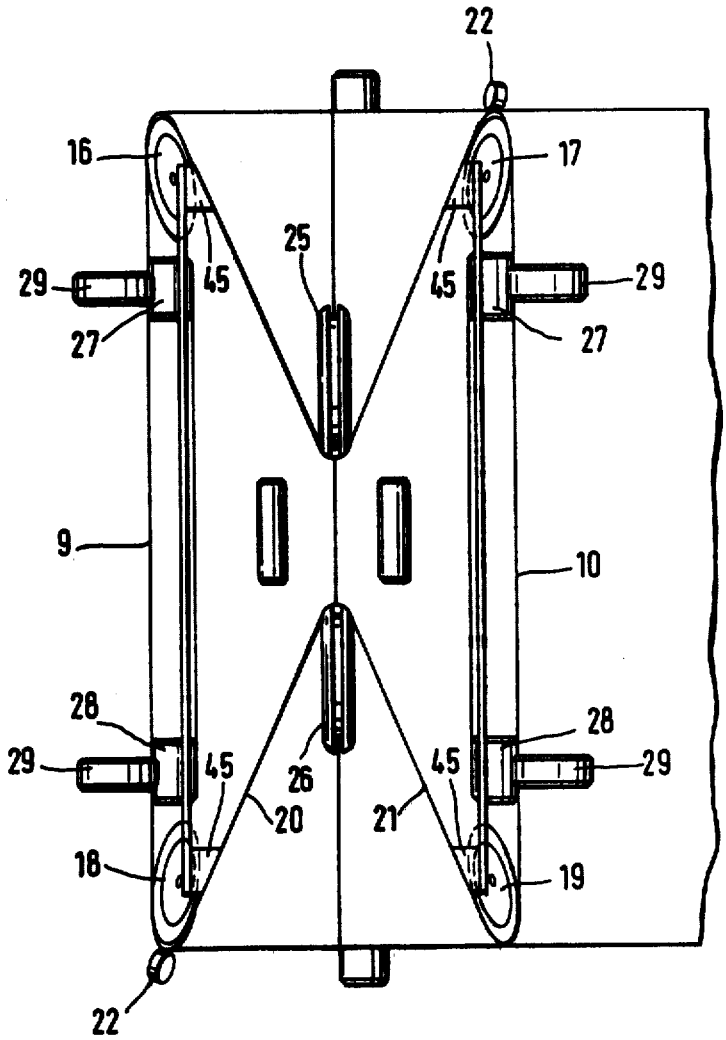
Figure 7:
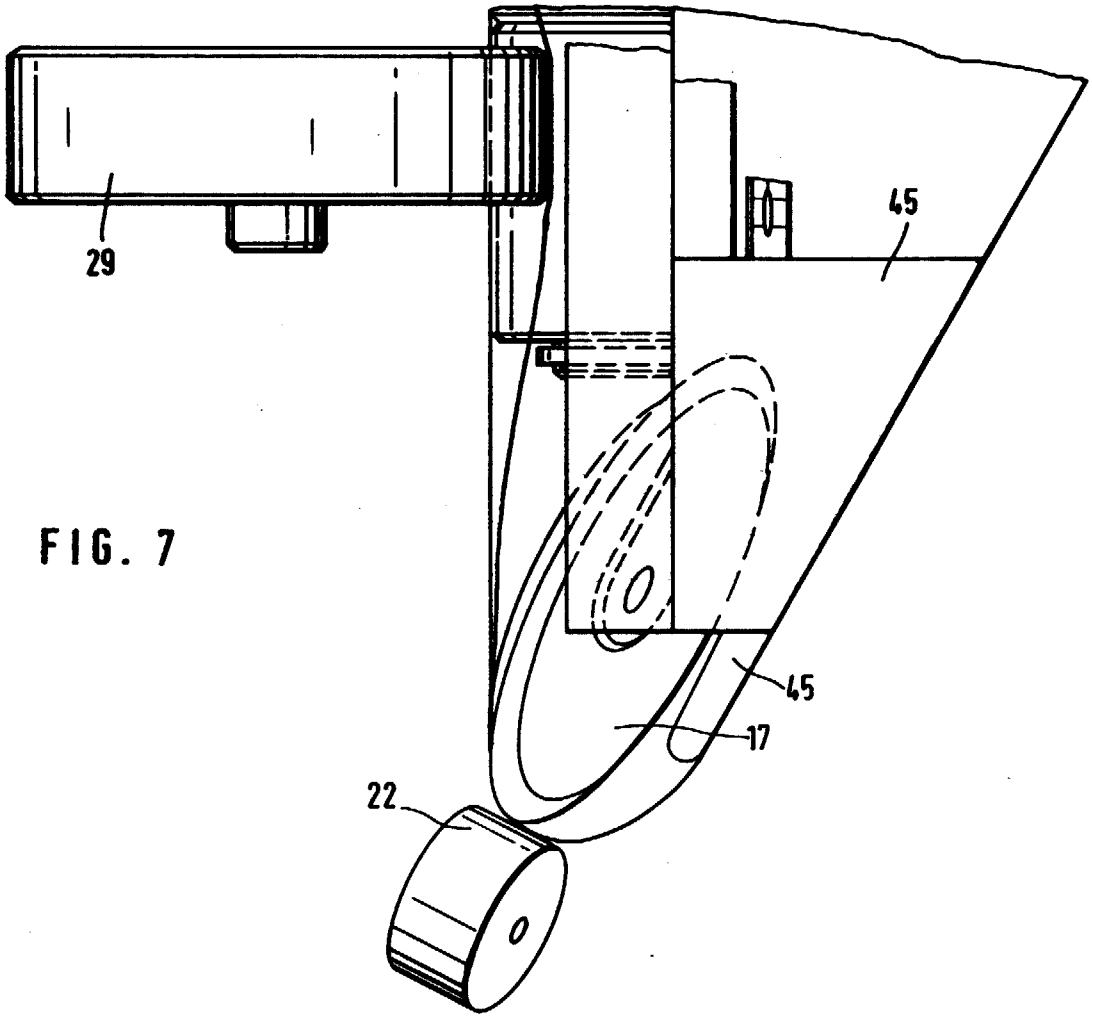
Figure 9:
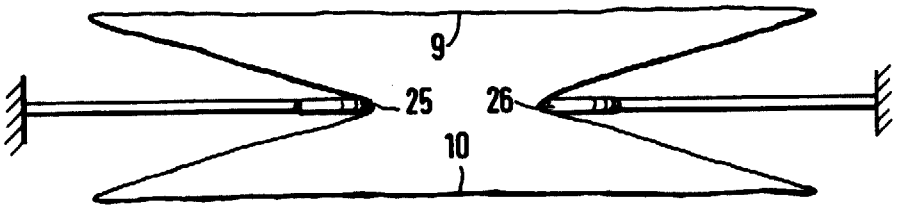
Figure 8:
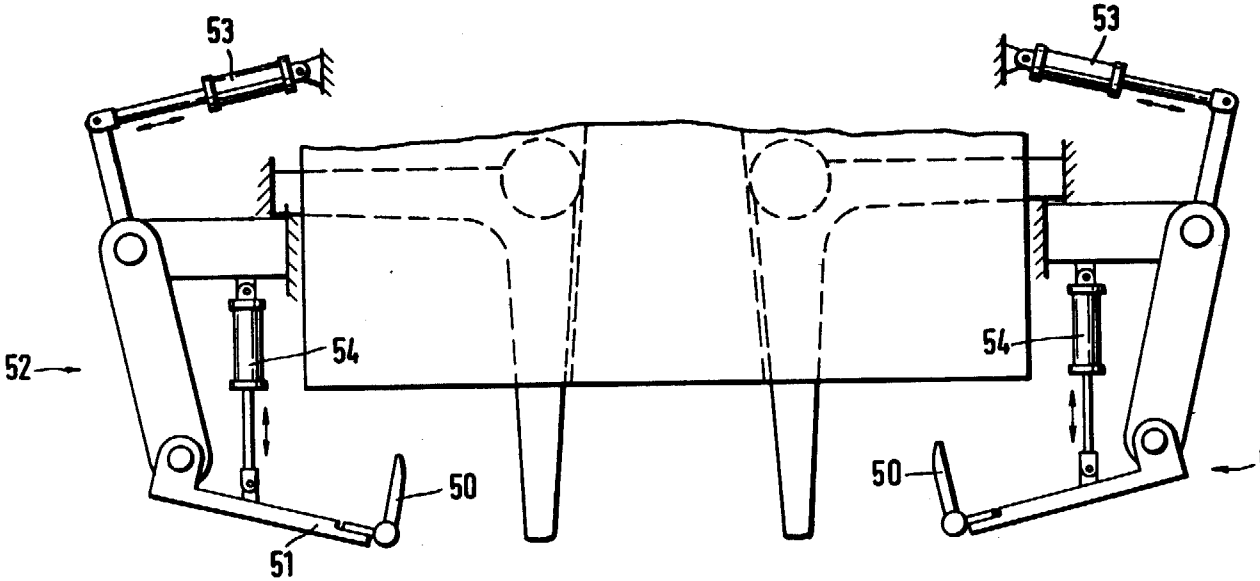
Figure 12:
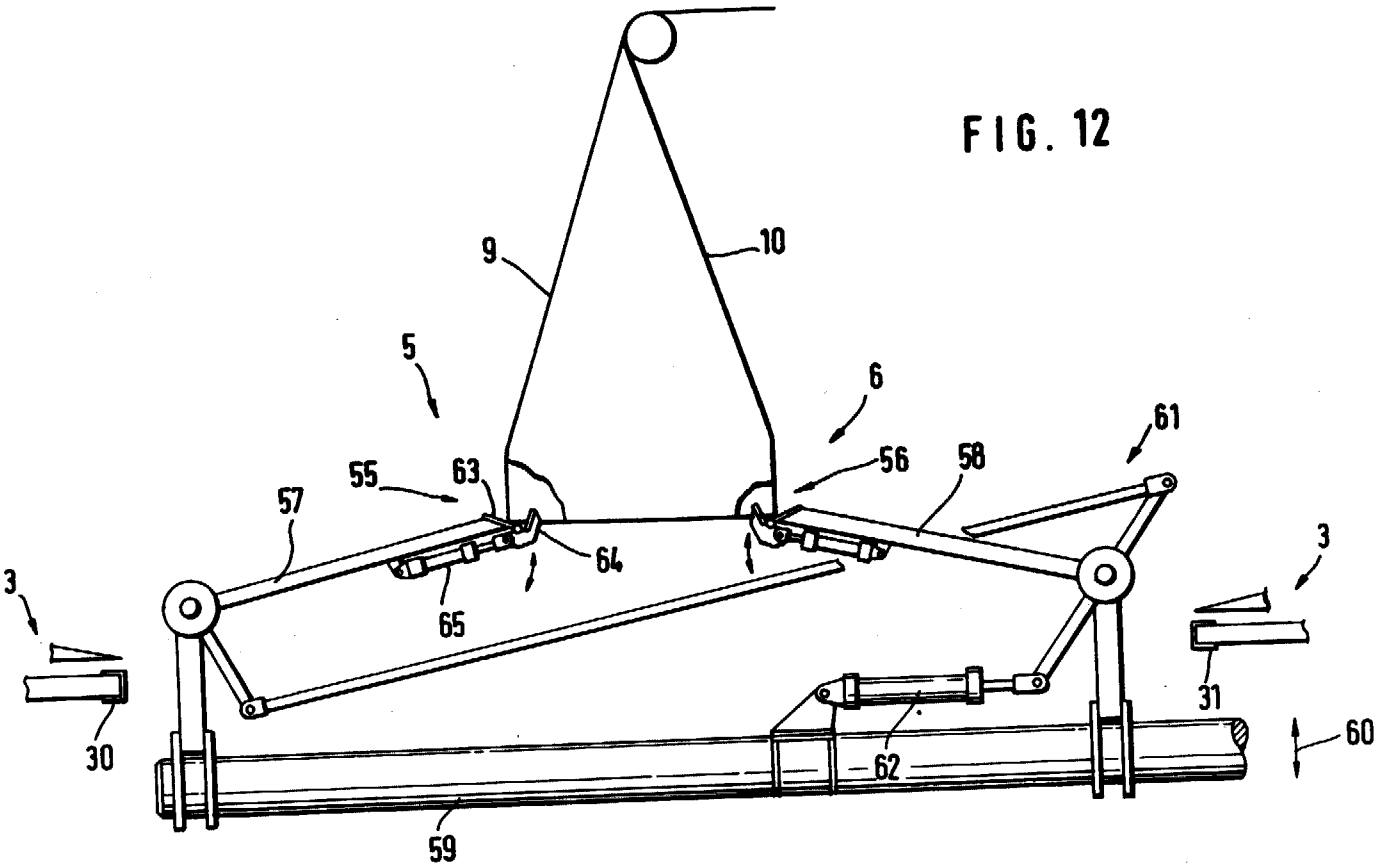
Figure 13:
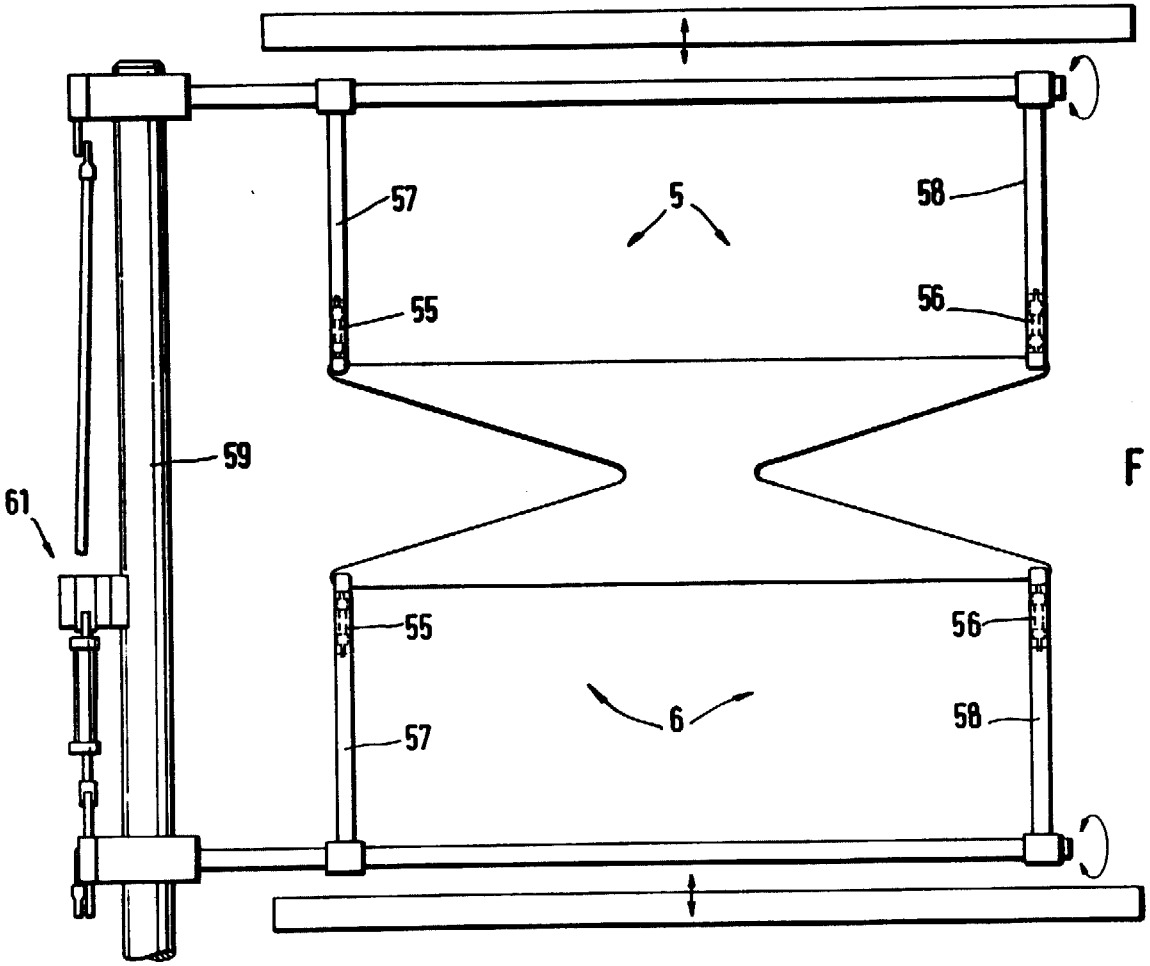

The embodiments of the invention shown in the drawings are discussed below:

FIG. 1 is a schematic side view of the lower part of equipment for pulling shrink hoods over a stack of goods;

FIG. 2 is the upper part of the equipment with the fusion and cutting device and also movable grippers, FIG. 3 is a top view of the object of FIG. 1, FIG. 4 is an enlarged cut-out of the object of FIG. 3, FIG. 5 is a schematic elevation of another equipment for pulling shrink hoods over stacks of goods, FIG. 6 is part of the object of FIG. 5, seen from below, FIG. 7 is an enlargement of part of the object of FIG. 6, FIG. 8 is a schematic elevation of a tensioning device, FIG. 9 is a view from below of the hood opening as yet not tensioned open, FIG. 10 is a view from below of the hood opening tensioned open, FIG. 11 is a partial elevation of the object of FIG. 8, FIG. 12 is a partial elevation of the grippers, FIG. 13 is a view from below of the hood seized by the grippers, FIG. 14 is an enlarged part of the object of FIG. 12, and FIG. 15 is another projection of the object of FIG. 14.

The equipment shown is used for pulling hoods made of shrinkable foil sleeves over stacks of goods. In its basic design it consists of a device for unwinding a flat-laid foil sleeve 1 from a supply roll 2, a fusing and cutting device 3 for implementing cross-seams and severing sleeve sections 4, and movable grippers 5, 6 for seizing the free hood edge 7.

As can be seen by comparing the FIG. 1 and 2, the movable grippers 5, 6—which at the same time from the device for unwinding the flat-laid foils sleeve 1 from the supply roll 2—are mounted above the fusing and cutting device 3, whereby the initially flat-laid foil sleeve 1 is made to pass vertically through the equipment.

A device 8 for spreading open the mutually opposite walls 9, 10 of the flat-laid foil sleeve are mounted underneath the fusing and cutting device 3 (FIG. 1). The foil sleeve 1 is a side-pleats sleeve.

The foil sleeve 1 unwound from the supply roll 2 first is guided over a tensioning device 11 and then over direction-changing roller 12 mounted underneath the spreading device 8. The foil sleeve then arrives in the area of the spreading device 8 comprising a spreading structure not shown in detail and located within the foil sleeve 1. The spreading structure comprises at its lower end a roller 13 resting against one or both of the walls 9 and 10 of the foil sleeve and associated with machine-fixed support plates 14, 15 external to the foil sleeve 1 and subtending an angle with the vertical and thereby defining the angle of spread of the foil sleeve 1 to be spread open. In lieu of a single roll 13 it is also possible to arrange two rolls next to each other, each resting against one wall, 9 and 10, and possible supported by the support plates 14 and 15 resp.

Moreover the spreading structure is provided at its upper side 4 associated with the fusing and cutting device 3 with rotatable disks 16, 17, 18, 19 of which the axes are so arranged that the particular disk planes extend about centrally between planes formed at the spread-open sleeve-end on one hand by the associated wall 9 or 10 and on the other by the particular adjoining pleats 20 and 21 respectively. As shown particularly clearly by FIG. 3, the disks 16 through 19 by means of their peripheral rims run along the pleat lines between the walls 9 and 10 and the adjoining side pleats 20 and 21 resp. The disks 16 through 19 are associated moreover with machine-fixed support rolls 22 external to the foil sleeve.

Moreover two more rolls 25, 26 are pivotably or displaceable supported at the machine frame against the effects of springs 24, namely at the approximate height of the disks 16 through 19. These rolls 25 and 26 enter the particular side pleats 20 and 21 resp. and run on the pleat lines of the side pleats 20, 21. As they are stressed by the associated springs 24, they tension the already spread-open foil sleeve 1 in the peripheral direction in the manner represented in FIG. 3.

Lastly rolls 27, 28 are also mounted at the spreading structure in the plane of the roll 16 through 19 and each between the rollers 16, 18 and 17, 19, with which moreover are associated support rolls 29 external to the foil sleeve 1. The walls 9 and 10 of the foil sleeve 1 are guided in a topologically smooth manner over these rolls 27 and 28. Also, the spreading structure is secured against lateral tilting by these rolls 27, 28 and the associated support rolls 29.

The equipment shown operates as follows: The initial condition is that shown in FIG. 1, for which a free hood edge 7 remains above the spreading device 8 after the previous hood has been served. This hood edge is seized by the grippers 5, 6 which are pivoted in a suitable manner and are guided until over the hood edge 7. In the process the grippers 5, 6 must pass through the plane of the fusing and cutting device 3. On that account the fusing and cutting device 3 is provided with two fusing jaws 32, 33 displaceable in the directions of the arrows 30 and 31 resp. and comprising installed cutting edges 34. The fusing jaws 32, 33 are kept apart while the grippers 5, 6 move downward, i.e. pivot, in order to seize the upper free hood edge 7. Thereupon the grippers 5, 6 pull up the sleeve end, whereby a corresponding section of the foil sleeve 1 will be unwound from the supply roll 2 and a further section in the device 8, i.e. by means of it, is guided for the purpose of being spread open. The sleeve section 4 joining the hood edge 7 initially assumes a prismatic shape with a cross-section such as is defined by the walls 9, 10 and the side pleats 20, 21 in FIG. 2. After the grippers 5, 6 have been moved up over a path corresponding to the desired hood length, the two fusing jaws 30, 31 are moved toward each other, carrying along the walls 9, 10 and the corresponding segments of the side pleats 20, 21 and clamping them between them, whereby a cross-seam defining the bottom of the hood is formed and simultaneously the sleeve section 4 forming the hood is severed underneath the cross-seam 35. The severed edge again forms a new hood edge 7 which will be seized by the grippers 5, 6 in the next operation.

The equipment shown in FIG. 5 through 15 is used for pulling hoods made of shrinking foil sleeves over stacks of goods. It also consists of a device for unwinding a flat-laid foils sleeve 1 from a supply roll 2, a fusing and cutting device 3 for implementing cross-seams and severing sleeve sections 4, and movable grippers 5, 6 to seize the free hood edge 7. As can be seen in FIG. 5, the foil sleeve 1 is unwound from the supply roll 2 to pass over a direction-changing roll 40 located at the height of an operational platform 41, first in the upward direction and then over another direction-changing roll 42, a tensioning system 11 with a compensating roll 43, whereup it is deflected downward by another direction-changing roll 44 and fed to a device 8 for spreading open the mutually opposite walls 9, 10 of the flat-laid foil sleeve.

The spreading device 8 comprises a spreading structure not shown in detail and located within the foil sleeve 1. At its lower side the spreading structure is provided with rotating disks 16, 17, 18 and 19 of which each axis is so arranged that the particular disk planes extend about centrally between the plane formed at the spread-open foil sleeve on one hand by the associated wall 9 or 10 and on the other hand the planes formed the particular adjoining side pleats 20 and 21 resp. As shown particularly clearly by FIG. 6, the disks 16 through 19 by means of their particular peripheral rims along the pleat lines between the walls 9 and 10 resp. and the adjoining side pleats 20 and 21. Machine-fixed support rolls 22 are associated with the disks 16 through 19 outside the foil sleeve, of which the axes are parallel to the axes of the associated disks.

Moreover guide plates 45 are provided in the area of the disks 16 through 19, of which the outsides guide the foil sleeve in the area of its pleat lines.

Moreover two further rolls 25, 26 are displaceably or pivotably supported by the machine frame against the effect of springs (not shown), namely at about the height of the disk 16 through 19. These rolls 25 and 26 enter the particular side pleats 20 and 21 and run against the pleat lines of the side pleats 20, 21. Being loaded by the associated springs, they tension the already spread open foil sleeve 1 in the manner shown in FIG. 6 and FIG. 9.

Lastly, rolls 27, 28 are also mounted somewhat below the disks 16 through 19 at the spreading structure, which rest on machine fixed support rolls 29 external to the foil sleeve 1. Together with rolls 46, 47 arranged at about half the height of the spreading structure and borne through the walls 9, 10 by machine fixed support rolls 48, 49, the said rolls support the spreading structure. A devide for tensioning the opening of the sleeve end by means of tensioning fingers 50 moving into the opening and tensioning it open is located underneath the spreading structure. Always two tensioning fingers 50 are mounted to a common carrier 51, and at a distance from this carrier, so that the foil material does not catch in the carrier.

The carriers 51 of the tensioning fingers 50 are supported on a lever linkage 52 associated with two pneumatic cylinders 53, 54 as the setting means. The kinematics of the lever linkages 52 is such that the tensioning fingers 50 move into the openings of the spread-open sleeve end as shown in FIG. 9 and then can be displaced outwardly until they enter the corners of the X-shaped opening. When the tensioning fingers are pulled outwardly by the actuation of the pneumatic cylinders 53, they also tension the walls 9, 10 of the foil sleeve in such a manner that henceforth the edge of these walls 9, 10 can be seized by grippers which pull the edge and the adjoining sleeve section over a stack of goods below (not shown).

The grippers 5, 6 shown in FIG. 12 each comprise two gripper tongs 55, 56. The gripper tongs 55, 56 are each mounted at the ends of gripper arms 57, 58. The gripper arms are pivotably mounted on a bar 59 which in turn can be moved up and down in the direction of the arrow 60, whereby the grippers 5, 6 are capable of pulling a sleeve section, later to become a hood, from the spreading structure and of pulling it further over the stack of goods underneath.

As can be seen by comparing the FIGS. 12 through 15, grippers 5, 6 are coupled together by a lever linkage 61, a pneumatic cylinder 62 acting as the setting means.

It will be noted from FIG. 14 that each gripper tong 55 (56) comprises a tong jaw 63 solidly mounted to the associated gripper arm 57 (58), where the inside of said jaw acting as the clamping surface is roughened. A further tong jaw 64 is supported in articulating manner at the gripper arm 57, i.e. at the extended tong jaw 63, and rests by means of a pneumatic cylinder 65 as the setting means on the associated gripper arm 57 (FIG. 12). The pivoting tong jaw 64 in the embodiment shown (FIG. 14) comprises a convex projection 66 so that when the gripper tongs are closed, a specific clamping force can be achieved between the two tongs.

Also a stripper means 67 is mounted to the pivoting tong jaw 64, which when the tongs open strips off any foil adhering to the fixed tong jaw 63.

The equipment shown operates as follows: the initial condition is that shown in FIG. 5, where a free sleeve edge 7 remains, following the severing of the previous hood, underneath the spreading device 8. The tensioning fingers 50 then are moved into the opening (FIG. 9) surrounded by the hood edge 7 and they are so moved apart that the condition shown in FIG. 10 obtains. Now the grippers 5, 6 can seize the tensioned edge of walls 9, 10 (FIG. 13) and pull another section of the foil sleeve 1 from the spreading device and also over the stacks of goods underneath it. The grippers 5, 6 may pass through the components of the moved-apart fusing and cutting device. After a sufficient length has been pulled off, the fusing jaws 30, 31 of the fusing and cutting device are moved toward each other, whereby they carry along the walls 9, 10 and corresponding parts of the side pleats 20, 21 and clamp them between themselves, so that a fused cross-seam defining the bottom of the hood to be formed is obtained and simultaneously the sleeve section forming the hood is severed underneath the fused cross-seam. The severed edge forms a new hood edge 7 which will be seized by the grippers 5, 6 in the next operational stage.

I claim:

1. Apparatus for pulling hoods made of shrinkable foil over stacks of wares comprising:

(a) a supply spool;

(b) a flattened foil sleeve wound upon said supply spool, (c) said sleeve having a free openable end and being an end portion of a continuous tube having an external outer surface and an internal surface, in cross-section said tube comprised of a pair of mutually opposed walls, a pair of side walls connecting the opposed walls together with each side wall having at least one inwardly directed pleat therein mutually opposed walls and said side walls forming corner regions in said sleeve;

(d) mobile gripping means for gripping said free openable end of said sleeve and for drawing said sleeve from said supply spool;

(e) support means for contacting and guiding said external outer surface of said drawn sleeve;

(f) spreading means supported by said support means, receivable within said free openable end of said sleeve for engaging and spreading apart said opposed walls of said drawn sleeve;

(g) said spreading means comprising a first spreading structure including first guide disks positioned within said corner regions of said sleeve for internally guiding said sleeve and a pair of opposed, inwardly directed guide disks for externally engaging the pleats in said side walls, said first guide disks and said opposed guide disks having axes which are substantially coplanar;

(h) a welding and cutting device for subsequently welding a cross-seam in said spread apart sleeve at a location on said sleeve remote from said free end and for subsequently severing said sleeve at a location adjacent to said cross-seam thereby forming a separated hood having a spread apart opened end and a sealed end while providing the remaining portion of said sleeve with a newly formed, spread apart free end;

(i) said opened end of said hood being seized by said mobile gripping means for subsequent placement over a stack of wares; and, (j) said mobile gripping means being subsequently engageable with said newly formed free end of said sleeve for drawing additional sleeve from said supply spool.

2. Apparatus as in claim 1 and wherein:

(a) said pair of opposed disks being springloaded for applying external pressure to said side walls

3. Apparatus as in claim 2 and wherein:

(a) said first guide disks being substantially flat; and, (b) each of said first guide disks being positioned within a corresponding corner region in said sleeve whereby each disk plane substantially bisects its corresponding corner region.

4. Apparatus as in claim 3 and wherein:

(a) a pair of opposed guide rollers being positioned within said sleeve for guiding said opposed walls of said sleeve;

(b) each of said guide rollers extending between and interconnecting an adjacent pair of first guide disks; and, (c) first support rolls positioned externally of said sleeve for supporting said opposed guide rollers.

5. Apparatus as in claim 1 and wherein:

(a) second support rolls being positioned externally of said sleeve for supporting said first guide disks.

6. Apparatus as in claim 5 and wherein:

(a) each of said second support rolls having an axis which is parallel to the axis of its associated first guide disk.

7. Apparatus as in claim 6 and wherein:

(a) guidance plates being positioned adjacent each of said first guide disks for guiding said internal surface of said sleeve.

8. Apparatus as in claim 1 and wherein:

(a) said spreading means further comprising a second spreading structure located in advance of said first spreading structure.

9. Apparatus as in claim 8 and wherein:

(a) said second spreading structure comprising at least one guide roll positioned within said sleeve in advance of said first guide disks.

10. Apparatus as in claim 9 and wherein:

(a) a pair of support plates being positioned externally of said sleeve for supporting said guide roll of said second spreading structure.

11. Apparatus as in claim 9 and wherein:

(a) a pair of third support rolls being positioned externally of said sleeve for supporting said guide roll of said second spreading structure.

12. Apparatus as in claim 1 and wherein:

(a) tensioning means cooperating with said mobile gripping means including tensioning fingers engageable within said newly formed, spread apart free end of said sleeve for tensioning said spread apart free end in an opened position prior to engagement by said gripping means.

13. Apparatus as in claim 12 and wherein:

(a) said tensioning fingers being spring-loaded.

14. Apparatus as in claim 12 and wherein:

(a) said tensioning fingers being connected to and guided by lever linkages; and, (b) said lever linkages being activated by fluid activated cylinders.

15. Apparatus as in claim 1 and wherein:

(a) said mobile gripping means including a pair of gripper tongs, each of said gripper tongs being mounted to a controlled, movable gripper arm; and, (b) each of said gripper tongs including a first and a second tong jaw.

16. Apparatus as in claim 15 and wherein:

(a) a first tong jaw being rigidly mounted to said gripper arm;

(b) a second tong jaw being pivotally connected to said gripper arm; and, (c) a fluid activated cylinder controlling said pivotal movement of said second tong jaw.

17. Apparatus as in claim 16 and wherein:

(a) a stripping lever being attached to said second tong jaw for stripping foil adhering to said first tong jaw upon pivoting of said second tong jaw with respect to said first tong jaw.

18. Apparatus as in claim 16 and wherein:

(a) said first and said second tong jaws each having distal end portions, and mating surfaces; and, (b) said mating surfaces being limited to said distal end portions.

* * * * *